US012560418B1

(12) United States Patent
Sadler et al.

(10) Patent No.: US 12,560,418 B1
(45) Date of Patent: Feb. 24, 2026

(54) EXPLOSIVE FIRING TRAIN WITH A SINGLE EXPLOSIVE TRANSFER INTERFACE

(71) Applicant: Raytheon Company, Arlington, VA (US)

(72) Inventors: Coulton T. Sadler, Tucson, AZ (US); Eric D. Goertz, Whitewater, CO (US); Montgomery Carlo, Sahuarita, AZ (US); Christopher F. Williams, Tucson, AZ (US)

(73) Assignee: Raytheon Company, Arlington, VA (US)

( * ) Notice: Subject to any disclaimer, the term of this patent is extended or adjusted under 35 U.S.C. 154(b) by 0 days.

(21) Appl. No.: 18/954,077

(22) Filed: Nov. 20, 2024

(51) Int. Cl.

| | |
|---|---|
| ***F42C 15/40*** | (2006.01) |
| ***F42B 3/12*** | (2006.01) |
| ***F42C 11/00*** | (2006.01) |
| ***F42C 19/12*** | (2006.01) |

(52) U.S. Cl.
CPC ..... *F42C 19/12* (2013.01); *F42B 3/12* (2013.01); *F42B 3/125* (2013.01); *F42C 11/00* (2013.01); *F42C 15/40* (2013.01)

(58) Field of Classification Search
CPC ..... F42B 3/10; F42B 3/12; F42B 3/13; F42B 3/121; F42B 3/124; F42B 3/125; F42B 3/127; F42C 11/00; F42C 11/001; F42C 11/005; F42C 11/006; F42C 11/007; F42C 15/40; F42C 19/02; F42C 19/12
USPC ..... 102/202.5, 202.7, 202.14
See application file for complete search history.

(56) References Cited

U.S. PATENT DOCUMENTS

| | | | | |
|---|---|---|---|---|
| 4,788,913 A | | 12/1988 | Stroud et al. | |
| 5,088,413 A | * | 2/1992 | Huber | F42B 3/125 102/202.1 |
| 5,969,286 A | * | 10/1999 | Ward | F42B 3/13 102/202.7 |
| 6,752,083 B1 | | 6/2004 | Lerche et al. | |

(Continued)

FOREIGN PATENT DOCUMENTS

| | | |
|---|---|---|
| CA | 2497099 C | 5/2015 |
| CA | 2880368 C | 6/2017 |

OTHER PUBLICATIONS

Excelitas Technologies, "Datasheet EFI Detonator", Retrieved Online. URL: <https://www.excelitas.com/product/efi-detonators>, (2023), 3 pgs.

(Continued)

*Primary Examiner* — James S Bergin
(74) *Attorney, Agent, or Firm* — Schwegman Lundberg & Woessner, P.A.

(57) ABSTRACT

An EFI or LEEFI provides enhanced detonation energy sufficient to directly detonate a main charge to improve the reliability and ease the qualification of an explosive firing train. This is accomplished by forming the EFI's output charge from an explosive material typically used as a booster explosive (e.g., PBXN-5, CH-6 and Composition A5) rather than a primary explosive and making the diameter of the output charge greater than the diameter of the barrel thus increasing the total mass of the output charge. The explosive firing train now requires only a single explosive transfer interface. For use in military grade munitions, the EFI's casing is formed with one or more vent holes radially adjacent the output charge.

20 Claims, 5 Drawing Sheets

(56) References Cited

U.S. PATENT DOCUMENTS

| | | | | |
|---|---|---|---|---|
| 8,091,477 | B2 | 1/2012 | Brooks et al. | |
| 8,230,788 | B2 * | 7/2012 | Brooks | F42B 3/121 361/251 |
| 8,281,718 | B2 | 10/2012 | Rice | |
| 8,291,824 | B1 | 10/2012 | Welle et al. | |
| 10,480,910 | B2 * | 11/2019 | Scholtes | F42B 3/121 |
| 10,794,670 | B1 | 10/2020 | Nance et al. | |
| 11,060,827 | B1 | 7/2021 | Krueger | |

OTHER PUBLICATIONS

Pacsci EMC, "Exploding Foil Initiator", Retrieved online. URL: <https://psemc.com/wp-content/uploads/2018/10/Exploding-Foil-Initiator-Datasheet.pdf>, 1 pg.

Scholtes, J.H.G., et al., "Development of Exploding Foil Initiators for Future IM", Retrieved Online. URL: <https://api.semanticscholar.org/CorpusID:107740626>, (2007), 9 pgs.

"U.S. Appl. No. 18/954,148, Non Final Office Action mailed Dec. 29, 2025", 6 pgs.

* cited by examiner

EXPLOSIVE FIRING TRAIN WITH A SINGLE EXPLOSIVE TRANSFER INTERFACE

BACKGROUND

Field

This disclosure relates to explosive firing trains in which the initiator is an explosive foil initiator (EFI).

Dcscription of the Related Art

An explosive firing train is a sequence of events that culminates in the detonation of a main charge (high explosive). For safety reasons, most widely used high explosives are difficult to detonate. A primary explosive of higher sensitivity, and often a booster explosive of intermediate sensitivity, are used in sequence to trigger a unifom, predictable and reliable detonation of the main charge. Although the primary explosive itself is a more sensitive and expensive compound, it is only used in small quantities and in relatively safely packaged forms. By design there are low explosives, booster explosives and high explosives having progressively more explosive energy per unit mass made such that the low explosives are highly sensitive, the booster explosives have intermediate sensitivity and the high explosives are comparatively insensitive. Each of the explosives is a different explosive material or composition. For example, primary explosives may be HNS or RSI-007, booster explosives may be PBXN-5, CH-6 or Composition A5 and the main charge may be PBXN-9, LX-14, PBXN-110, PBXN-109 or PBXN-112. This not only affords inherent safety to the usage of high explosives during handling and transport but also necessitates an explosive firing train that includes an initiator, a booster and the main charge.

Many military grade munitions such as bombs and missiles, constitute Insensitive Munitions (IMs). IMs are designed to withstand stimuli representative of severe but credible accidents. The range of stimuli include shock, heat and adjacent detonation munitions. Military grade munitions must also be highly reliable. The main charge must detonate when commanded. The testing for both reliability and IM compliance is very rigorous.

Referring now to FIG. 1, a typical explosive firing train 100 includes an Electronic Safe & Arm Dcvice (ESAD) 102, an initiator 104 such as an EFI, Low Energy EFI (LEEFI), an exploding bridgewire (EBW) or low voltage detonator that initiates an output charge (the primary explosive), a fuze booster 106 and a main charge 108. The explosive firing train includes two explosive transfer interfaces. A first interface 110 is at the aft facing surface of fuze booster 106 defined by the gap between initiator 104 and fuze booster 106. A second interface 112 is an inner surface of a fuze well 114 defined by a gap (axial and radial) between the main charge 108 and fuze booster 106. Precise gapping is critical to uniform, predictable and reliable detonation of the main charge. If the gapping is too large, the energy in the detonation waves dissipates and may not initiate the next explosive in the train. If the gapping is too small the detonation waves may not properly form before impacting the next explosive in the train. Qualifying explosive transfer interfaces is quite rigorous.

Referring now to FIG. 2, assuming an EFI or LEEFI initiator, the output charge (primary explosive), booster explosive (charge) and main charge have successively higher detonation thresholds T1, T2 and T2 (progressively less sensitive) as determined by the composition of each explosive. The detonation threshold corresponds to a shock pressure applied for a given duration. The ESAD generates an electric stimulus e.g., a particular high-voltage waveform. The EFI or LEEFI 104 converts the electric stimulus to mechanical energy such as an accelerated mass or "flyer plate" that impacts the primary explosive with sufficient detonation energy E1 (above threshold T1) to detonate the output charge (primary explosive). The detonation energy is specified in terms of detonation pressure and detonation velocity. The EFI or LEEFI produces a detonation wave that impacts the first explosive transfer interface of the fuze booster with sufficient detonation energy E2 (above threshold T2) to detonate the booster explosive, which in turn produces a detonation wave that impacts the second explosive transfer interface of the main charge with sufficient detonation energy E3 (above threshold T3) to detonate the main charge. As previously mentioned, if the gapping to the explosive transfer interfaces are not precisely controlled, the detonation energies E2 and E3 may not be properly formed and of sufficient energy to detonate the booster explosive and main charge.

Referring now to FIG. 3, a standard EFI 300 includes a metal or plastic casing 302 having a diameter $D_c$, a chip 304 positioned in the bottom of the casing having multiple electrical leads 306 that extend through the casing, a barrel 308 having a through hole 310 and an output charge 312. The barrel and output charge have diameters $D_b$ and $D_{pe}$ equal to the diameter of the casing $D_c$. As previously mentioned, because the output charge is an expensive compound (e.g., HNS or RSI-007), it is only used in small quantities. Chip 304 converts electrical energy into mechanical energy in the form of an accelerating mass or "flyer plate" that accelerates through the through hole 310 and impacts and detonates the small output charge 312. More specifically a high-voltage electrical stimulus creates a plasma from a foil on the chip, which drives another thin plastic or metal foil to create the mass or "flyer plate."

Referring now to FIG. 4, a fuze booster 400 includes a mass of booster explosive (charge) 402 in a metal sleeve 404. Typical, booster explosives include PBXN-5, CH-6, and Composition A4. The sleeve may be provided with one or more vent holes 406, which are designed to allow the explosive 402 to vent (instead of explode) during fast cookoff or slow cookoff insensitive munition testing. An IM liner 408 (e.g., plastic) around the booster explosive 402 melts away and allows venting when subjected to high temperatures.

SUMMARY

The following is a summary that provides a basic understanding of some aspects of the disclosure. This summary is not intended to identify key or critical elements of the disclosure or to delineate the scope of the disclosure. Its sole purpose is to present some concepts of the disclosure in a simplified form as a prelude to the more detailed description and the defining claims that are presented later.

The present disclosure provides an explosive firing train that includes an EFI, a main charge and a single explosive transfer interface on the main charge. The EFI includes a circuit positioned in the bottom of a lower casing with a plurality of leads extending therethrough and a barrel having a through hole and an output charge positioned in an upper casing against and substantially aligned with the barrel through hole. The diameter $D_{oc}$ of the output charge is greater than the diameter $D_b$ of the barrel. The output charge having a lower detonation threshold and explosive energy than the main charge. In response to an electric stimulus, the circuit propels a flyer through the barrel's through hole to impact and detonate the output charge, which in turn impacts the single explosive transfer interface to detonate the main charge.

The EFI or LEEFI, both referred to herein as an EFI, provides enhanced detonation energy sufficient to directly detonate a main charge to improve the reliability and case the qualification of an explosive fire train. This is accomplished by forming the EFI's output charge from an explosive material typically used as a booster explosive rather than a primary explosive and making the diameter of the output charge greater than the diameter of the barrel thus increasing the total mass of the output charge. For use in military grade munitions, the EFI's casing is formed with one or more vent holes radially adjacent the output charge.

In an embodiment, an EFI includes a lower casing and an upper casing. A circuit is positioned in the bottom of the lower casing with a plurality of leads extending therethrough. A barrel having a through hole is positioned on top of the circuit. An output charge is positioned in the upper casing against and substantially aligned with the barrel through hole. The diameter $D_{oc}$ of the output charge is greater than the diameter $D_b$ of the barrel. In response to an electric stimulus, the circuit propels a flyer through the barrel's through hole to impact and detonate the output charge.

In an embodiment, the output charge diameter Do is at least 2× the barrel diameter $D_b$. The barrel diameter $D_b$ may be 0.25 to 0.5" and the output charge diameter $D_{oc}$ may be 1 to 3". Conventional military grade explosives include a fuze well that has a 3" diameter. For these explosives the diameter of the upper casing Duc would be just slightly less than 3" (e.g., 2.8 to 2.95") to provide the required radial gapping.

In an embodiment, the output charge has the detonation threshold and explosive energy characteristics of a conventional booster explosive. The detonation threshold is in a range between 1 to 3 Gpa (Giga Pascals) of shock pressure and the explosive energy is defined by a detonation pressure in a range between 27 to 38 Gpa and a detonation velocity in a range between 8,100 to 10,000 m/s. The output charge may be selected from one of PBXN-5, CH-6 and Composition A5. The output charge is not a conventional primary explosive such as HNS, RSI-007 or a main charge such as PBXN-9, LX-14, PBXN110, PBXN-109 and PBXN-112. The detonation thresholds and explosive energies of the primary explosive and main charge lie outside the defined ranges for the output charge.

In certain embodiments, the upper casing is provided with one or more vent holes that expose the output charge or IM liner.

In an embodiment of the explosive firing train, the main charge includes a fuze well having a diameter $D_w$. The EFI is positioned in the fuze well with a small axial and radial gapping to the inner walls of the fuze well to define the single explosive transfer interface. Typically, the fuze well diameter $D_w$ is 3 inches. The EFI's upper casing, hence barrel diameter, is slightly less than 3 inches to provide the proper gapping. One or more vent holes are formed in the EFI's upper casing adjacent the radial gap.

These and other features and advantages of the disclosure will be apparent to those skilled in the art from the following detailed description of preferred embodiments, taken together with the accompanying drawings, in which:

DETAILED DESCRIPTION

During testing and qualification of conventional EFI components and explosive firing trains, it was discovered that an EFI's flyer plate delivered sufficient energy (shock pressure and duration) to reliably initiate the fuze booster. This was an unexpected result. Conventional wisdom was that a highly sensitive primary explosive was required to initiate the explosive firing train. The 3-stage explosive firing train is well-established and accepted practice to safely and reliably detonate high explosives. Because these primary explosives are typically expensive, only a small amount sufficient to generate enough energy to initiate the fuze booster was used.

The present disclosure provides an EFI or LEEFI, both referred to herein as an EFI, that provides enhanced detonation energy sufficient to directly detonate a main charge to improve the reliability and case the qualification of an explosive fire train. This is accomplished by forming the EFI's output charge from an explosive material typically used as a booster explosive rather than a primary explosive and making the diameter of the output charge greater than the diameter of the barrel thus increasing the total mass and detonation energy of the output charge. Elimination of an explosive transfer interface from the explosive firing train is highly desirable. For use in military grade munitions, the EFI's casing is formed with one or more vent holes radially adjacent the output charge.

Figure 1:
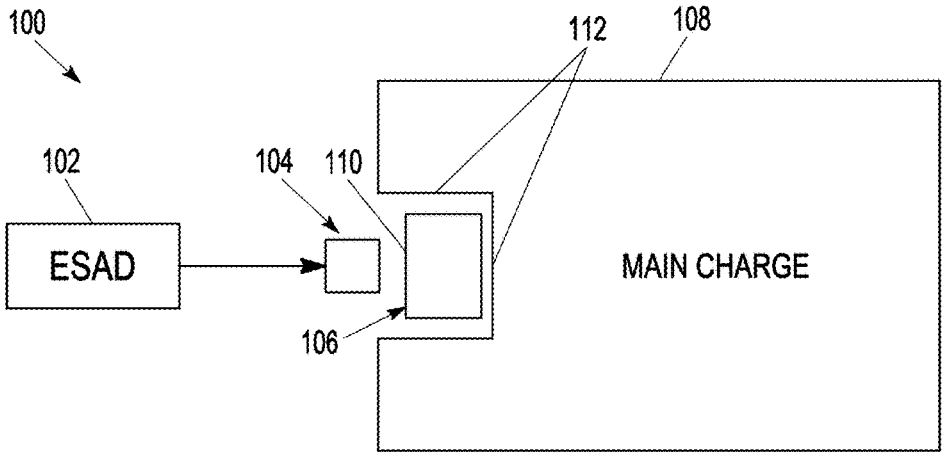
FIG. 1 (PRIOR ART)
FIG. 1, as described above, illustrates an embodiment of an explosive firing train.
Figure 2:
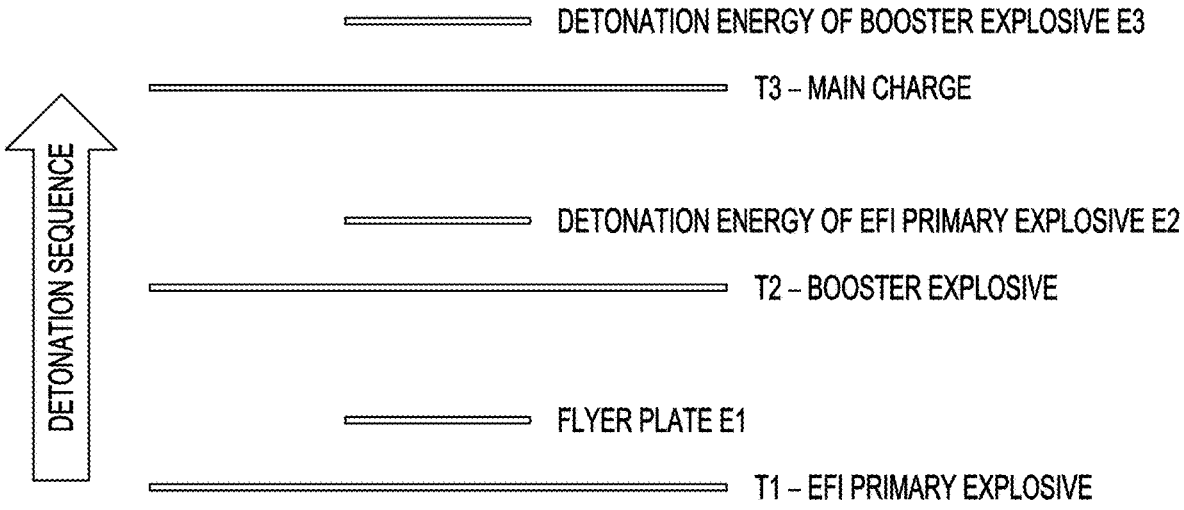
FIG. 2 (PRIOR ART)
FIG. 2, as described above, illustrates the detonation energies and detonation thresholds of the primary explosive, booster explosive and main charge.
Figure 3:
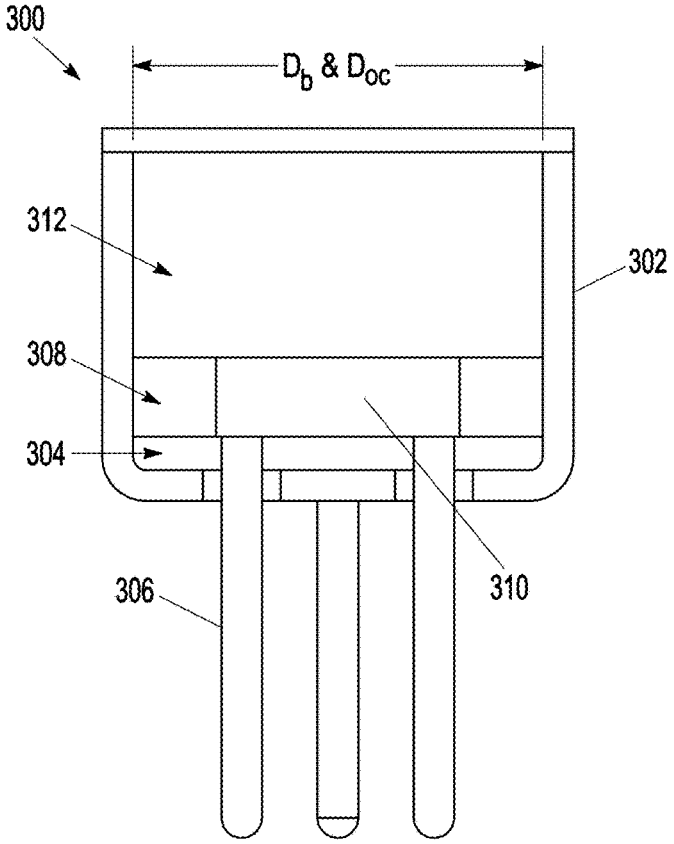
FIG. 3 (PRIOR ART)
FIG. 3, as described above, is a section view of a conventional EFI.
Figure 4:
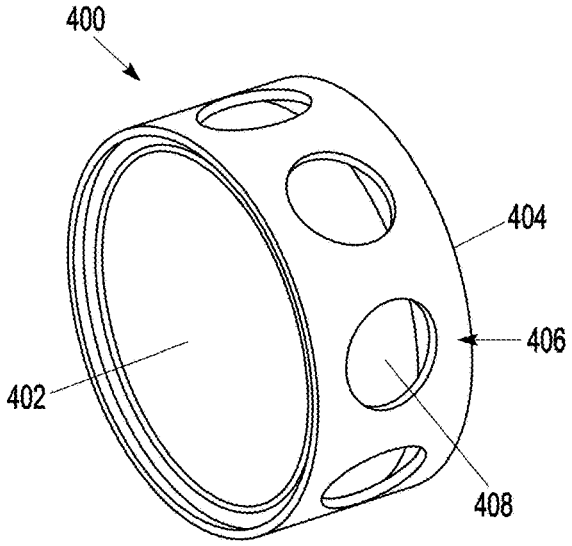
FIG. 4 (PRIOR ART)
FIG. 4, as described above, is a perspective view of a fuze booster.
Figure 5A:
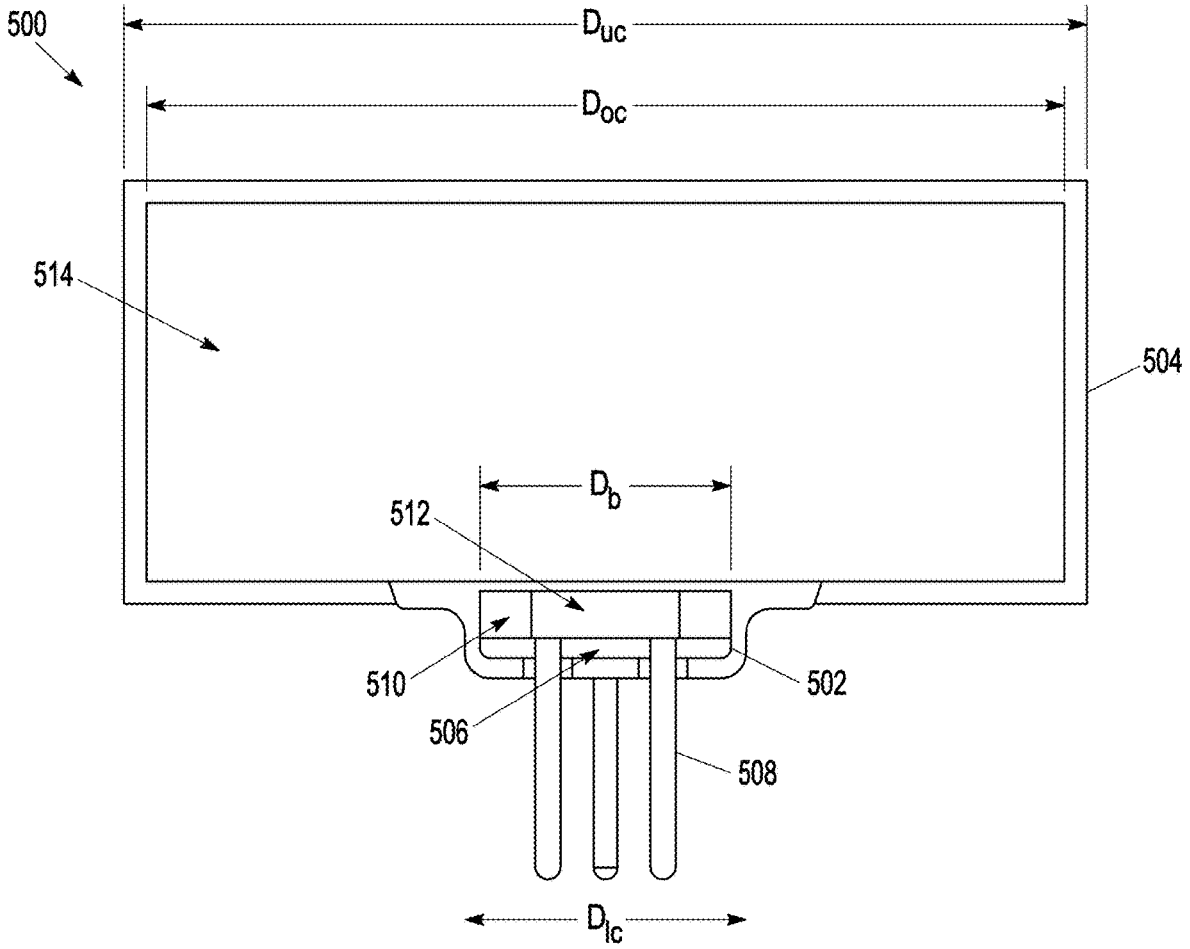
FIGS. 5A-5B are different section views of an embodiment of an EFI designed to enhance detonation energy.
Figure 5B:
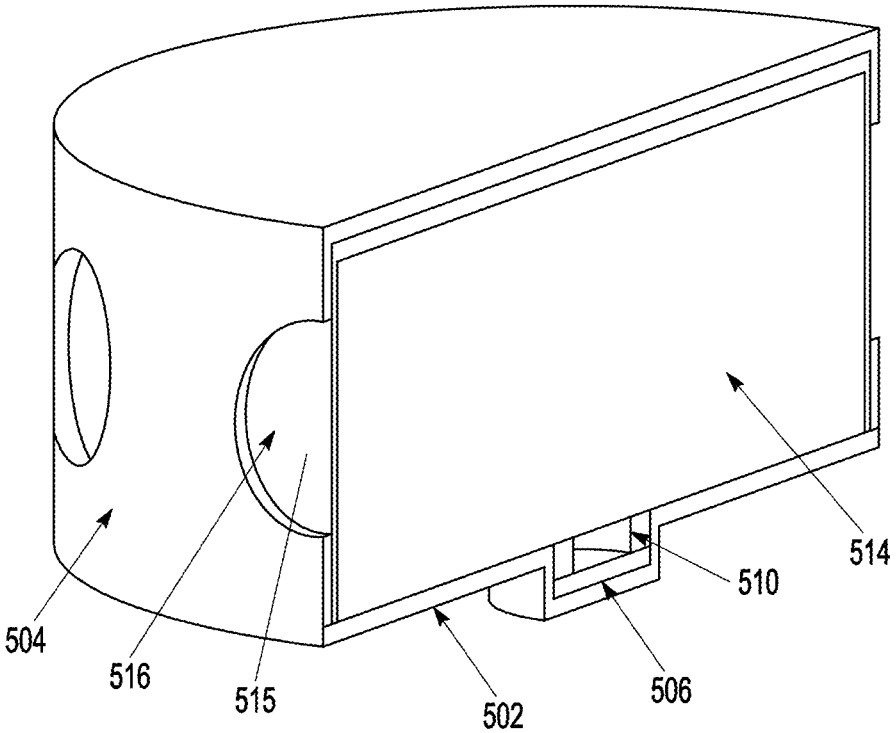

Referring now to FIGS. 5A-5B, an enhanced detonation energy EFI 500 includes a lower casing 502 having diameter Die and an upper casing 504 having a diameter Due. The casings are typically metal. A circuit or "EFI chip" 506 is positioned in the bottom of the lower casing with a plurality of leads 508 extending therethrough. A barrel 510 having a through hole 512 is positioned on top of the circuit. An output charge 514 is positioned in the upper casing against and substantially aligned with the barrel through hole 512. In a preferred embodiment, the EFI includes only a single output charge 514. An IM liner 515 may be positioned around output charge 514. The diameter $D_{oc}$ of the output charge is greater than the diameter $D_b$ of the barrel. In response to an electric stimulus, the circuit propels a flyer through the barrel's through hole to impact and detonate the output charge 514.

In an embodiment, the output charge diameter $D_{oc}$ is at least 2× the barrel diameter $D_b$. The barrel diameter $D_b$ may be 0.25 to 0.5" and the output charge diameter $D_{oc}$ may be 1 to 3". Conventional military grade explosives include a fuze well that has a 3" diameter. For these explosives the diameter of the upper casing Due would be just slightly less than 3" (e.g. 2.8 to 2.95") and at least 5× the barrel diameter to provide the required radial gapping.

In an embodiment, the output charge has the detonation threshold and explosive energy characteristics of a conventional booster explosive. The detonation threshold is in a range between 1 to 3 Gpa (Giga Pascals) of shock pressure and the explosive energy is defined by a detonation pressure in a range between 27 to 38 Gpa and a detonation velocity in a range between 8,100 to 10,000 m/s. The output charge may be selected from one of PBXN-5, CH-6 and Composition A5. The output charge is not a conventional primary explosive such as HNS, RSI-007 or a main charge such as PBXN-9, LX-14, PBXN-110, PBXN-109 and PBXN-112. In certain embodiments, the upper casing is provided with one or more vent holes 516 that expose the IM liner 515.

Figure 6:
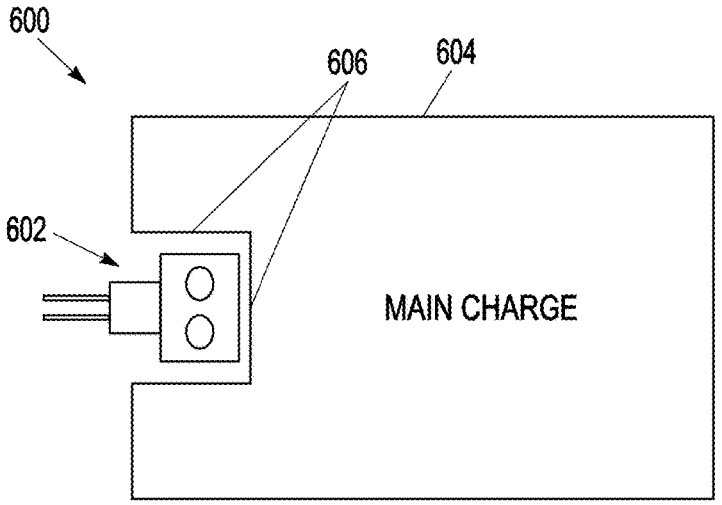
FIG. 6 illustrates an embodiment of an explosive train having a single explosive transfer interface between the EFI and the main charge.

Referring now to FIG. 6, an embodiment of an explosive firing train includes 600 an enhanced detonation energy EFI 602, a main charge 604 and a single explosive transfer interface 606 on the main charge. Main charge 604 includes an axial fuze well 608 that is standardly 3" in diameter for military explosives. The EFI 602 is positioned in the fuze well with a small axial and radial gapping between the EFI's upper casing and the inner walls of the fuze well to define the single explosive transfer interface. The EFI's upper casing diameter, hence barrel diameter, is slightly less than 3 inches to provide the proper gapping. One or more vent holes are formed in the EFI's upper casing adjacent the radial gap. Alternately, the EFI 602 could be positioned to initiate the main charge in a solely axial or solely radial configuration with a single explosive transfer interface.

Figure 7:
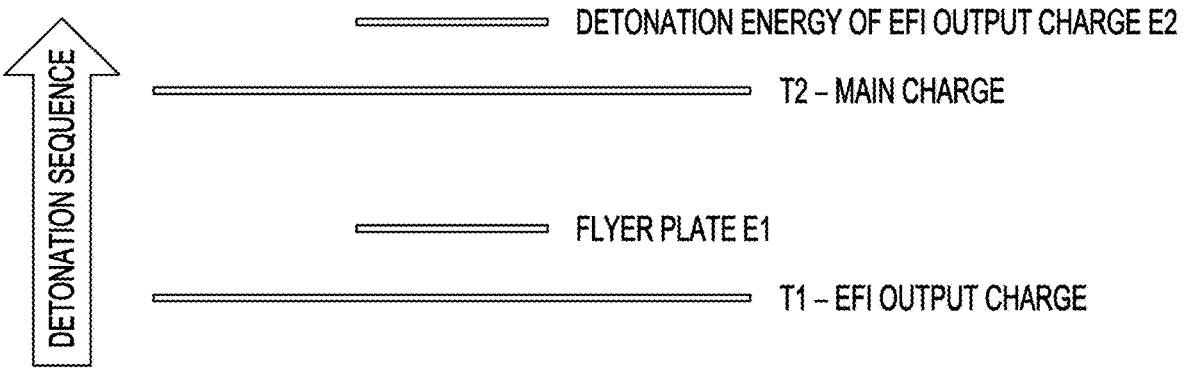
FIG. 7 illustrates the detonation energies and detonation thresholds of the EFI's output charge and main charge.

Referring now to FIGS. 6 and 7, in response to an electric stimulus, the EFI 602 propels a flyer through the barrel's through hole to impact and detonate the output charge, which in turn impacts the single explosive transfer interface 606 to detonate the main charge 604. The flyer plate impacts the EFI output charge with sufficient detonation energy E1, exceeding the output charge's detonation threshold T1, to detonate the output charge. In turn, the detonation wave from the EFI's output charge impacts the single explosive transfer interface 606 with sufficient detonation energy E2, exceeding the main charge's detonation threshold T2, to detonate the main charge.

While several illustrative embodiments of the disclosure have been shown and described, numerous variations and alternate embodiments will occur to those skilled in the art. Such variations and alternate embodiments are contemplated, and can be made without departing from the spirit and scope of the disclosure as defined in the appended claims.

We claim:

1. An explosive firing train, comprising:

an explosive foil initiator (EFI);

a main charge; and a single explosive transfer interface on the main charge, wherein the EFI includes a circuit positioned in the bottom of a lower casing with a plurality of leads extending therethrough and a barrel having a through hole and an output charge positioned in an upper casing against and substantially aligned with the barrel through hole, a diameter $D_{oc}$ of the output charge being greater than a diameter $D_b$ of the barrel, said output charge having a lower detonation threshold and explosive energy than the main charge;

wherein in response to an electric stimulus, the circuit accelerates a flyer plate through the barrel's through hole to impact and detonate the output charge, which in turn impacts the single explosive transfer interface to detonate the main charge.

2. The explosive firing train of claim 1, wherein plasma from a foil on the circuit drives another thin plastic or metal foil to create the flyer plate.

3. The explosive firing train of claim 1, where $D_{oc}$ is at least $2\times D_b$.

4. The explosive firing train of claim 3, wherein $D_b$ is between 0.5 inches and 1 inch and $D_{oc}$ is between 1 and 3 inches.

5. The explosive firing train of claim 3, wherein a diameter Due is between 2.8 and 3 inches.

6. The explosive firing train of claim 1, where in the output charge is selected from one of PBXN-5, CH-6 and Composition A5.

7. The explosive firing train of claim 1, wherein the output charge is not HNS or RSI-007.

8. The explosive firing train of claim 1, wherein the main charge is selected and the output charge is not selected from PBXN-9, LX-14, PBXN-110, PBXN-109 or PBXN-112.

9. The explosive firing train of claim 1, wherein the output charge has a detonation threshold of between 1 to 3 Gpa of shock pressure.

10. The explosive firing train of claim 9, wherein the output charge when detonated reaches a detonation pressure of between 27 to 38 Gpa and a detonation velocity of between 8,100 to 10,000 m/s.

11. The explosive firing train of claim 1, wherein the upper casing includes one or more radial vent holes.

12. The explosive firing train of claim 1, wherein only a single output charge resides in the upper casing.

13. An explosive firing train, comprising:

an explosive foil initiator (EFI);

a main charge having a fuze well with an inner diameter of 3 inches; and a single explosive transfer interface on the main charge, wherein the EFI includes a circuit positioned in the bottom of a lower casing with a plurality of leads extending therethrough and a barrel having a through hole and an output charge positioned in an upper casing against and substantially aligned with the barrel through hole, a diameter $D_{oc}$ of the output charge being greater than a diameter $D_b$ of the barrel, said output charge having a lower detonation threshold and explosive energy than the main charge;

wherein a diameter Duc of the upper casing is between 2.8 and 3.0 inches and $D_{oc}>=5*D_b$ wherein in response to an electric stimulus, the circuit accelerates a flyer plate through the barrel's through hole to impact and detonate the output charge, which in turn impacts the single explosive transfer interface to detonate the main charge;

wherein said output charge has a detonation threshold of 1 to 3 Gpa of shock pressure and when detonated reaches a detonation pressure of 27 to 38 Gpa and a detonation velocity of 8,100 to 10,000 m/s.

14. The explosive firing train of claim 13, wherein plasma from a foil on the circuit drives another thin plastic or metal foil to create the flyer plate.

15. The explosive firing train of claim 13, where in the output charge is selected from one of PBXN-5, CH-6 and Composition A5.

16. The explosive firing train of claim 13, wherein the output charge is not HNS and RSI-007.

17. The explosive firing train of claim 13, wherein the upper casing includes one or more radial vent holes.

18. The explosive firing train of claim 13, wherein main charge has a fuze well with an inner diameter of 3 inches, wherein the upper casing has a diameter Duc between 2.8 and less than 3 inches, wherein $D_{oc}$>=5*$D_b$.

19. The explosive firing train of claim 13, wherein the upper casing includes one or more radial vent holes.

20. The explosive firing train of claim 13, wherein the main charge is selected and the output charge is not selected from one of PBXN-9, LX-14, PBXN-110, PBXN-109 or PBXN-112.

* * * * *